US006638172B1

(12) United States Patent
Demars

(10) Patent No.: US 6,638,172 B1
(45) Date of Patent: Oct. 28, 2003

(54) SELF DEFENSE WEAPON COVERING

(76) Inventor: Darlene Marcos Demars, 25834 Barnett La., Stevenson Ranch, CA (US) 91381

( * ) Notice: Subject to any disclaimer, the term of this patent is extended or adjusted under 35 U.S.C. 154(b) by 0 days.

(21) Appl. No.: 10/206,435

(22) Filed: Jul. 29, 2002

(51) Int. Cl.[7] ..... F41B 15/00
(52) U.S. Cl. ..... 463/47.2; 446/473
(58) Field of Search ..... 463/47.2, 47.6; 206/349, 806; 434/11; 446/473; 482/83

(56) References Cited

U.S. PATENT DOCUMENTS 2,455,215 A * 11/1948 Beckwith ..... 264/257
2,803,087 A * 8/1957 Zalkind ..... 446/473
4,655,456 A * 4/1987 Chen Dai ..... 463/47.2
5,630,998 A * 5/1997 Parsons ..... 434/11
5,706,941 A * 1/1998 Erisoty ..... 206/349
D429,122 S * 8/2000 Stokes

* cited by examiner

*Primary Examiner*—William M. Pierce
(74) *Attorney, Agent, or Firm*—Erik M. Arnhem

(57) ABSTRACT

A self-defense implement having a handle and multiple pointed prongs can be equipped with protective gloves for use when the implement is employed for training and instructional purposes. Each protective glove has a closed end covering the pointed end of an associated prong, and an elongated sleeve section covering a substantial portion of the prong length.

1 Claim, 1 Drawing Sheet

SELF DEFENSE WEAPON COVERING

FIELD OF THE INVENTION

This invention relates to an ancient Okanawan farm tool, Sai. This implement is used as a self defense weapon that can be seen demonstrated in Kata Forms using multiple striking, blocking, and piercing to ward off an attacker, Kata's imaginary fight between two or more opponents. More particularly, the invention relates to a sleeve type cover or shield that can be slipped over a prong of a self-defense weapon when the weapon is to be used as a training device, whereby the covered weapon can be wielded safely without fear that it could wound or injure the person using the weapon or the person's opponent.

BACKGROUND AND SUMMARY OF THE INVENTION

In self defense training a multi-pronged implement, is employed to teach the student eye and hand coordination with procedures for warding off an attacker. U.S. Pat. No. 4,052,063, issued to Michael Wong on Oct. 4, 1977 shows one form that such an implement might take. The weapon shown in that patent is a multi-pronged implement having a handle, a main prong extending forwardly from the handle, and two auxiliary prongs extending in opposite directions parallel to the handle and main prong.

In another version, the implement can take a miniature "pitchfork" configuration that includes a handle and three generally parallel forks or prongs extending forwardly from the handle. The implement can have a total length slightly less than twelve inches. The prongs can have sharp pointed ends for wounding an attacker, e.g. with a forward lunging motion of the implement. This implement is commonly constructed in various sizes, so that the cover or shield also will be made in all sizes, large, medium and small.

The implement can be used in various ways. For example, the person can employ a forward lunging motion to thrust the sharpened prongs into the attacker's hand, body or arm. Alternately, the implement can be held in front of the person's face or body to ward off any blows by an attacker. Additionally, the person can swing the implement, as one might swing a tennis racket or hammer, to deliver a karate-like blow to the body of the attacker.

For real time usage the prongs of the implement have sharpened (or pointed) ends. However, for training purposes the prong ends need to be blunted, in order to prevent injury to the students, children and adults, participating in the training exercise.

The present invention relates to a cover construction that can be safely used in a training environment. For real-time usage the covers are removed from the prongs of the implement, so that the implement can effectively achieve its self-defense objective. In this day and age the covers could also be used for material Arts competitions, and or demonstrations.

Further features of the invention will be apparent from the attached drawings and description of an illustrative embodiment of the invention.

DESCRIPTION OF A PREFERRED EMBODIMENT OF THE INVENTION

Figure 1:
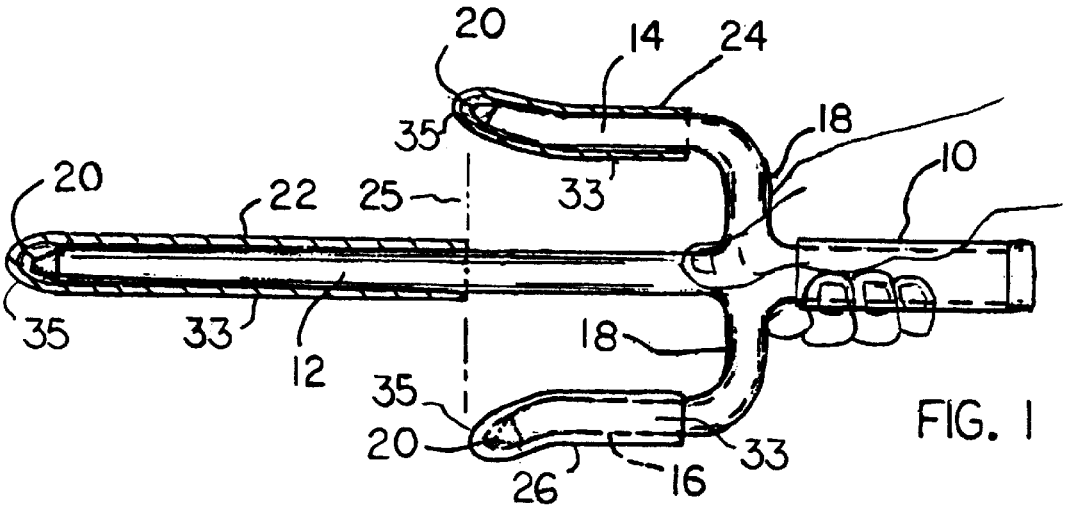
FIG. 1 is a side elevational view of a self-defense implement equipped with safety covers according to the present invention.

Referring to FIG. 1, there is shown a "pitchfork" shaped defense implement that has enjoyed some usage in the civilian population, by persons e.g., Martial Artists desiring to demonstrate the art of self defense with this implement through demonstrations and competitions world wide. The weapon (implement) includes a handle (or hand grip) 10, a first relatively ong prong 12 extending axially, or forwardly, from the handle, and two relatively short prongs 14 and 16 extending parallel to prong 12.

Each prong 14 or 16 is connected to handle 10 by means of an arm 18. The prongs and handle are located in a single common plane, i.e. the plane of the paper in FIG. 1. The three prongs each have a circular cross section. The end of each prong is sharpened (or pointed), as at 20 in FIG. 1.

Typically, the implement will be formed out of steel tubing sections that are bent, sharpened, and wielded together, to form a one piece implement having a miniature "pitchfork" configuration. For self defense purposes, the person grasps handle 10 and/or arms 18, for manipulating the implement, to repel an attack or to inflict injury to the attacker.

The implement can be thrust forward in a lunging motion to cause the pointed end of prong 12 to deliver a piercing motion to the attacker's body. Alternately, the person can grasp handle 10 so s to swing the implement in an arc, intended to achieve a slicing action by one of the three prongs first coming into contact with the attacker's body. The three prongs provide protection for the person when the implement is held in front of the person's face and body.

The present invention is concerned with a cover construction that can be employed on the prongs of the self-defense implement when the implement is to be used for training purposes. The covers are removed from the prongs when the implement is to be employed in real life Martial Arts demonstrations or competitions.

FIG. 1 shows a first sleeve-like cover 22 installed on prong 12, a second sleeve-like cover 24 installed on prong 14, and a third sleeve-like cover 26 installed on cover 16. The covers can be similarly constructed, although of different sizes to fit the differently dimensioned prongs. Each cover 2,24 or 26, fits snugly on the associated prong, so as to be precluded from slipping off the prong when the implement is swung in an arc (producing a centrifugal force tending to throw the cover off the prong).

As shown in FIG. 1, each cover includes an elongated sleeve section 33 extending along a major portion of the associated prong, and a closed end 35 covering the pointed end of the prong. Each cover is preferably formed of a relatively soft cushion-like material, e.g. padded leather or rubber, so that when the pointed tip or side surface of the prong forcibly strikes the opponent's body the force of the blow will be at least partially absorbed by the covering. The students learning how to use the implement can exert a reasonable amount of force without having to worry that the opponent will be seriously injured.

As shown in FIG. 1, the cover for prong 12 extends only partway along the prong length. Specifically, cover 22 has its open end located on an imaginary plane 25 that connects the pointed ends of prongs 14 and 16. The length of cover 22 is sufficient for the protective function, yet not so long as to make insertion or removal of the cover unduly difficult.

Figure 2:
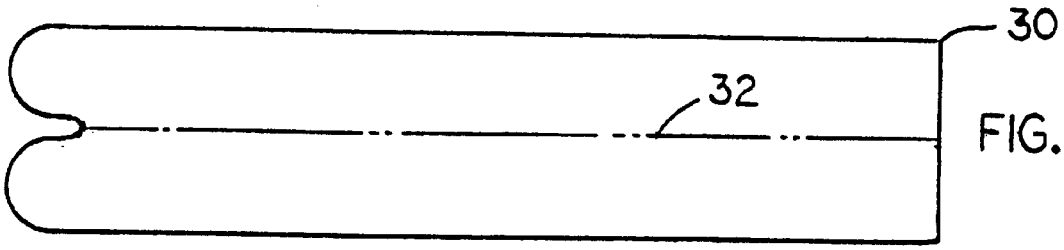
FIG. 2 is a plan view of a pattern that can be used to form a prong cover for the FIG. 1 implement.
Figure 3:
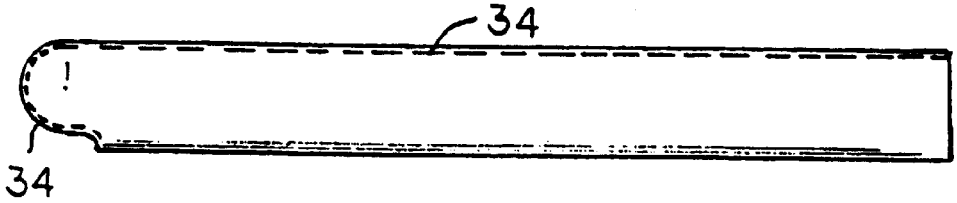
FIG. 3 shows a prong cover that can be formed, using the pattern depicted in FIG. 2.

FIGS. 2 and 3 show one way that cover 22 can be formed. The other covers 24 and 26 can be constructed, using a similar procedure. FIG. 2 shows a flat pattern 30 formed out of flexible cushion-like material, e.g. padded leather. The flat pattern is folded along longitudinal fold line 32 and then sewn along the mating peripheral edges of the material, as at 34 in FIG. 3.

The sewn article depicted in FIG. 3 is turned inside out so that the sewn seam faces the interior of the cover. Pattern 30 is dimensioned so that when the sewn cover is slipped on prong 12 the internal seam material will be in frictional pressure contact with the prong surface. The aim is to achieve a tight snug fit of the cover on the prong, so that the cover is precluded from slipping off the prong when the self-defense implement is swung or manipulated.

Figure 4:
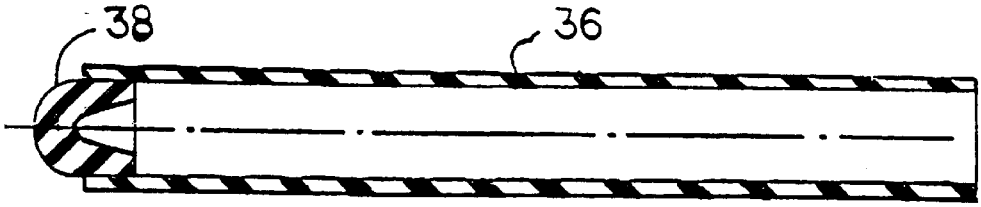
FIG. 4 shows another form that the prong cover can take, according to the present invention.

FIG. 4 shows another way that the prong cover can be constructed. In this case, the cover includes cylindrical sleeve 36 sized to fit snugly on the associated prong, and a plug-like end piece 38 suitably bonded to one end of the sleeve. An internal surface of the plug can be hollowed to mate with the pointed end of the prong.

The covers for the three prongs of the self-defense implement serve as protectors against injury from the hard metal prong surfaces during the training period. In addition the covers protect the thick cushion mats used during practices, testing and/or competitions. Use of the covers enables the student to develop the necessary skills in eye-hand coordination and weapon manipulation, without excessive fear that the student or the opponent might be seriously pierced, causing injury.

The covers are preferably constructed so as to fit snugly on the weapon prongs, to preclude the cover from the slipping off the prong when the implement is swung or moved in such fashion as to generate centrifugal force that could throw the cover off the prong. At the same time, the fit of the cover on the prong should not be so tight as to prevent initial insertion of the cover on the prong or subsequent removal of the cover from the prong.

Various expedients and methods can be used to facilitate installation or removal of the glove on/off the prong. For example, the glove can be inserted so that a slight gap exists between the prong tip 20 and the interior end surface of the glove, as shown in FIG. 1. This will provide material at the closed end 35 of the glove, that can be grasped to pull the glove off the prong. Also, tabs can be attached to the open end of each glove, to facilitate the insertion of the glove onto the prong (by a pulling operation). Various types of releasable clamps can be used to provide a localized grip of the glove on the prong; when the clamp is in the released condition the glove can be installed or removed.

The drawings show specific forms that the invention can take. However, it will be appreciated that the invention can be practiced in other forms and configurations.

What is claimed:

1. In combination with a self-defense training implement that includes a handle, a relatively long central prong extending axially from said handle, and two relatively short side prongs extending parallel to said central prong, each said prong having a pointed end; the improvement comprising:

a protective shield assembly for said prongs; said shield assembly comprising a protective glove installable on each prong; each glove having a closed end covering the pointed end of the respective prong, and a sleeve section extending a substantial distance from said closed end so that said glove covers a substantial length of the prong;

each said glove having an open end for inserting the respective glove onto one of the prongs;

the central protective glove for the central prong having such a length that the open end thereof is located on an imaginary plane connecting the pointed ends of the side prongs when said central glove is inserted on the central prong.

* * * * *